US005720576A

United States Patent [19]

Scuero

[11] Patent Number: 5,720,576

[45] Date of Patent: Feb. 24, 1998

[54] UNDERWATER CONSTRUCTION OF IMPERMEABLE PROTECTIVE SHEATHINGS FOR HYDRAULIC STRUCTURES

[75] Inventor: Alberto Scuero, Turin, Italy

[73] Assignee: Sibelon S.R.L., Arona, Italy

[21] Appl. No.: 585,019

[22] Filed: Jan. 11, 1996

[30] Foreign Application Priority Data

Jan. 13, 1995 [IT] Italy ..... M195A0063

[51] Int. Cl.[6] ..... E02B 7/04

[52] U.S. Cl. ..... 405/116; 405/107; 405/109

[58] Field of Search ..... 405/50, 53, 54, 405/107, 109, 116, 151; 52/247, 742.16, 741.4, 741.41, 169.5

[56] References Cited

U.S. PATENT DOCUMENTS

| | | | |
|---|---|---|---|
| 4,659,252 | 4/1987 | Sexton et al. | 405/109 |
| 4,832,528 | 5/1989 | Lisart | 405/109 X |
| 4,913,583 | 4/1990 | Ledeuil . | |
| 4,915,542 | 4/1990 | Fernando | 405/151 X |
| 5,143,480 | 9/1992 | Scuero . | |

FOREIGN PATENT DOCUMENTS

| | | |
|---|---|---|
| 1 634 140 | 4/1971 | Germany . |
| 27 34 525 | 2/1979 | Germany . |
| 34 12 548 | 6/1985 | Germany . |
| 38 31 188 | 3/1990 | Germany . |

*Primary Examiner*—Tamara L. Graysay
*Assistant Examiner*—Frederick L. Lagman
*Attorney, Agent, or Firm*—Young & Thompson

[57] ABSTRACT

A system for constructing underwater impermeable protective sheathings of hydraulic structures or parts of them. At least one reference line is provided on the surface area to be protected and a protective sheathing is constructed underwater by positioning and stretching impermeable sheet materials over the area, keeping one lateral edge of each sheet material parallely aligned to said reference line, and maintaining hydrostatic balanced conditions between the pressures on the front and rear faces of each sheet material; the sheets are afterwards watertight connected along their edges and anchored to the surface of the hydraulic structure by mechanical anchorage devices.

13 Claims, 3 Drawing Sheets

UNDERWATER CONSTRUCTION OF IMPERMEABLE PROTECTIVE SHEATHINGS FOR HYDRAULIC STRUCTURES

BACKGROUND OF THE INVENTION

The present invention relates to a method for constructing protective sheathings for hydraulic structures, such as dams, canals, reservoirs, tunnels, intake towers, by which it is possible to operate directly underwater, even at considerable depths, without the need to drain the basin, or to discharge the water in contact with the surface of the hydraulic structure to be protected. It is a common knowledge that surfaces in contact with water in dams, reservoirs, canals, or other similar hydraulic structures, are over time subject to continuous weathering and deterioration, caused by the mechanical eroding action of water and ice, and by other physical phenomena due to climate and air temperature variations occurring where the hydraulic structure is located. Moreover, concrete hydraulic structures may be excessively permeable to water, with subsequent water losses due to seepage and possible damage to the structure itself.

As a remedial measure to these inconveniences, traditional materials are often used, such as new concrete casting, reinforced gunite layers, bituminous membranes or other types of membranes, steel plates, coatings of resin based paints or renderings, consolidation grouting with concrete grout or chemical grout; these methods, however, have some construction problems, which subsequent uncertainty of results and questionable reliability as far as durability is concerned. Due to the various problems which have been encountered with the above traditional methods, various alternative solutions have been proposed to waterproof the side or the surfaces of the hydraulic structure which will be in contact with water. The U.S. Pat. Nos. 4,913,583 and 5,143,480 illustrate some possible examples for the waterproofing of hydraulic structures by means of an impermeable sheathing with flexible sheets in plastic material, such as geomembranes or geocomposites directly anchored on the surface to be protected.

In particular, by the above U.S. Pat. No. 5,143,480 a method to protect dams and similar structures is known, by which it is possible to achieve also an efficient dehydration of the structure body, by condensation and drainage at atmospheric pressure of the water present inside the dam body.

According to the aforementioned patents, the protection membrane is generally installed dry, after the basin has been emptied of the retained water to totally expose the surface to be lined and to allow repair works on the surface to be protected if that is the case, before the protection membrane is installed.

However, draining the basin or interrupting water flow inside a canal entails important problems. The main concern is the loss of water for power supply or irrigation and potable water supply purposes. Environmental impact can be an equally important concern in cases of exploitation of reservoirs or canals for recreational purposes. Moreover drainage itself can be the major problem: in hydraulic structures which have been constructed years ago it is not always possible to accomplish drainage, for example due to absence of outlets or impossibility of their proper operation, due to the possibility of affecting the downstream area, or for other sound reasons. In all these cases it is not practical to waterproof the hydraulic structure according to traditional techniques.

Although the U.S. Pat. No. 5,143,480 generally mentions the possibility of installing underwater protection sheathings of hydraulic structures, it does not practically supply any useful indication or instruction for the correct installation of the geomembranes underwater, which must take into account the depth and turbidity of water, the possible presence of water flows, the difficulty created by an underwater environment to some tasks which are otherwise easily performed dry. All these elements entail working conditions near the hydraulic structure to be protected, which would make positioning the plastic sheets constituting the geomembrane, and the execution of the necessary watertight sealing between adjoining sheets and along the perimeter of the area to be protected, a difficult and sometimes impossible task.

An object the present invention is to supply a method to construct waterproofing sheathings, with geomembranes or geocomposites, for the protection of hydraulic structures such as dams and related appurtenances, reservoirs, canals and similar, by which it is possible to operate underwater even at great depths, without the need to previously drain, ensuring a correct positioning of the geomembrane or geocomposite and the proper seals in any working condition.

A further object of the present invention is to supply a method for the application of geomembranes and/or geocomposites suitable for constructing protective sheathings for hydraulic structures, by which it is possible to install the protective sheathing in presence of water, ensuring a perfect positioning of the geomembrane without causing excessive stresses on the material sheets constituting the geomembrane, at the moment of their installation, and at the same time guaranteeing reliability of the execution.

As a matter of fact, underwater installation of waterproofing geomembranes must take into account several factors such as the extension of the surface to be protected, the difficulty and the length of time required for preparation of the surface to accommodate all protruding points or other irregularities which could involve the risk of puncturing or tearing the membrane. Moreover, the membrane during installation must be kept in such conditions as to allow it to resist to stresses occurring during installation itself.

SUMMARY OF THE INVENTION

These and other objects can be accomplished by a method for the underwater construction of protection sheathings for hydraulic structures, having the general characteristics of the invention, by which the protection membrane is constructed by defining a surface area to be protected and providing a reference line on the surface; by lowering underwater flexible sheets of impermeable material, positioning and tensioning each single sheet of material along the surface area to be protected by keeping one side edge of each sheet in line with the reference line and pressure balance conditions on both front and rear faces of the sheet; the tensioned sheets being then watertightly connected and secured along their edges by mechanical anchorage to the surface area to be protected. Mechanical anchorage of the sheets to the hydraulic structure is also made along the perimeter of the sheathing. The back pressure acting behind the membrane can afterwards be reduced by draining the water entrapped in the space between the protection membrane and the surface of the structure thus protected.

BRIEF DESCRIPTION OF THE DRAWINGS

Some embodiments for the system according to the invention are hereafter illustrated with reference to the enclosed drawings, where.

DESCRIPTION OF THE INVENTION

Figure 1:
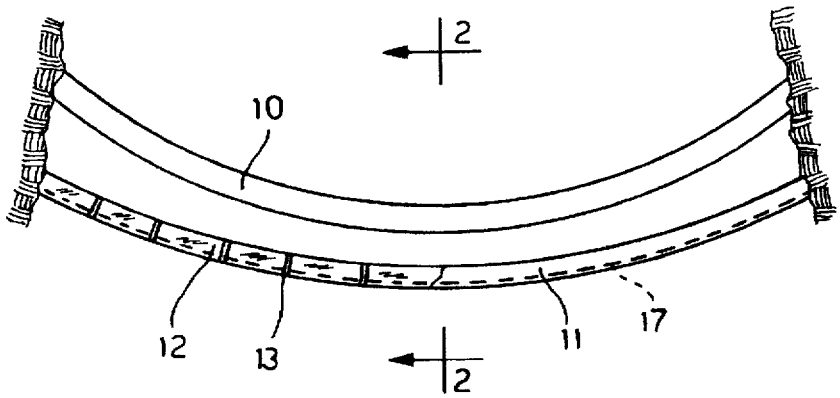
FIG. 1 is a schematic plan of the concrete body of a generic dam provided with a protection sheathing according to this invention.
Figure 2:
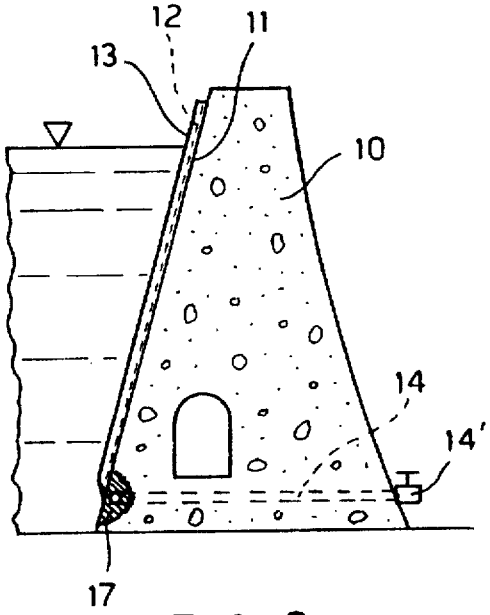
FIG. 2 is a cross sectional view along line 2—2 of FIG. 1.

In the example illustrated in FIGS. 1 and 2, reference 10 indicates the concrete body of a generic hydraulic structure, for example a dam, whose surface 11 which will be in contact with water must be suitably protected by a waterproofing sheathing or membrane 12 formed by a set of sheets in flexible synthetic material, for example polyvinylchloride (PVC), polypropylene (PP), high density polyethylene (HDPE), very low density polyethylene (VLDPE), which are watertightly anchored to the surface 11 by a system of vertical profiles 13. According to the example on issue, the assembly of profiles 13 constitutes a system of discharging conduits at atmospheric pressure to discharge towards the outside the condensed water seeping from the body of the hydraulic structure 10, and collecting in the air space or chamber 26 between the rear face of the protection membrane 12 and the surface 11 to be protected. The air chamber, in which at least one drainage layer may be installed, collects also waters infiltrating through ruptures or imperfections which should eventually affect the impermeable sheathing. In a low position, a drained water collection system, consisting of additional drainage layers or of a drainage profile or pipe, is installed. The way membrane 12 operates, constituting a sort of a barrier to vapor which allows extraction of condensed water from the body of the hydraulic structure 10, has already been illustrated in the previous U.S. Pat. No. 5,143,480, or in the corresponding application for Italian Patent No. 1,248,825 which forms an integral part of the present description.

According to this construction type of the invention, vertical profiles and a bottom profile suitably constructed and anchored to the concrete structure, are used for watertight anchoring the impermeable membrane 12, that is the material sheets which constitute it, to allow the underwater construction of the whole protective system. An example of construction of the system and of the related profiles is illustrated hereafter, with reference to FIGS. 2 to 6 of the enclosed drawings.

Figure 5:
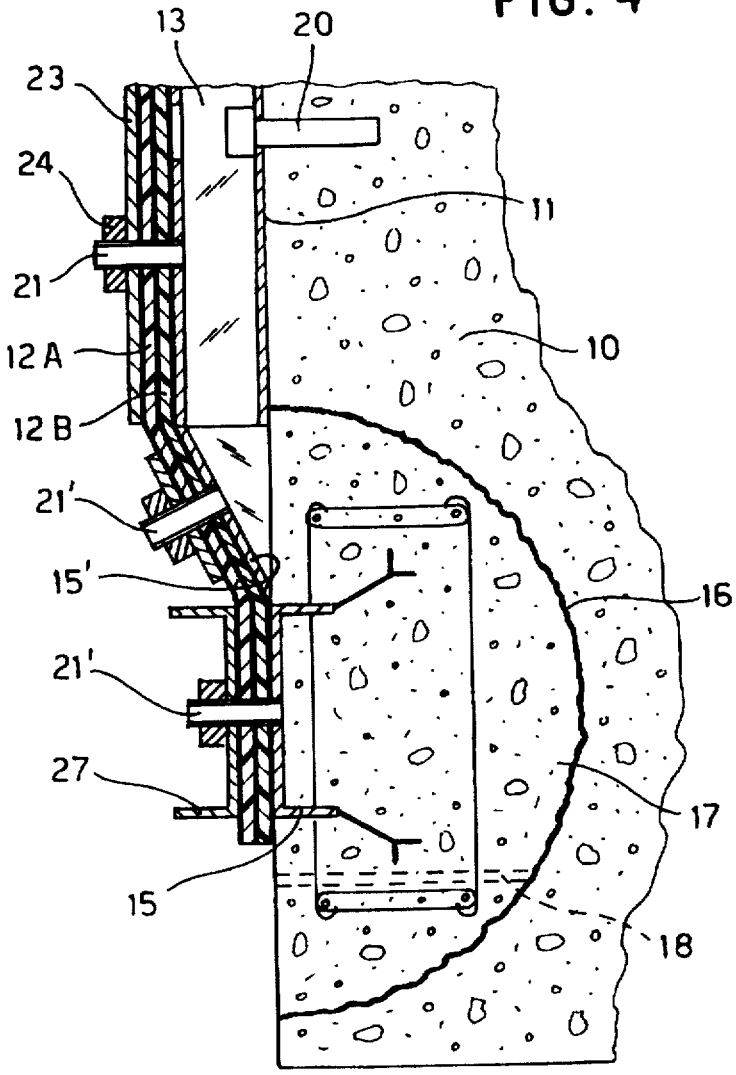
FIG. 5 is a second enlarged detail of FIG. 2 to illustrate a connection system between a vertical profile and a bottom profile for the watertight anchorage of the impermeable membrane.

As illustrated in FIG. 2 and in the enlarged view of FIG. 5, to achieve the watertight anchorage of the impermeable membrane 12 along the bottom perimeter, or along the inferior side of the area to be protected, it is possible to anchor and press the membrane against the concrete body 10 by a metal profile 27, consisting of several aligned sections, installing it on the surface 11 to be protected. In case the concrete body should not provide sound anchorage, along the above bottom perimeter of the structure 10 it is possible, as an alternative to other mechanical anchorage systems of the membrane, to construct a seating 16 in which, always operating underwater with known techniques, a concrete beam 17 is cast, to anchor the profile 15 in the way explained. In this case, the interface between the beam 17 and the internal surface of groove 16 must be sealed. This can be achieved, for example, by preparing, during construction of beam 17, suitable through holes 18 by which it will be afterwards possible grouting with suitable waterproofing resins, such as acrylic or epoxy resins, operating at the necessary grouting pressures.

After anchorage of the bottom edge of the protection membrane to the concrete surface with profile 15, the membrane is attached to the surface 11, by suitable anchorage elements, such as perforated vertical profiles 13, positioned at suitable distances; the shape and position of these elements is by the way of example only.

Figure 3:
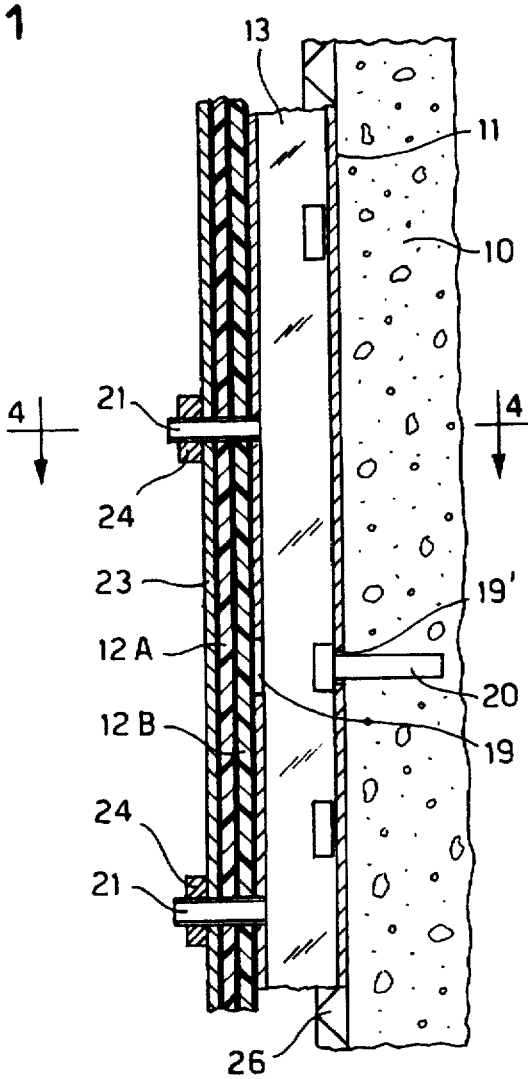
FIG. 3 is an enlarged detail of FIG. 2.
Figure 4:
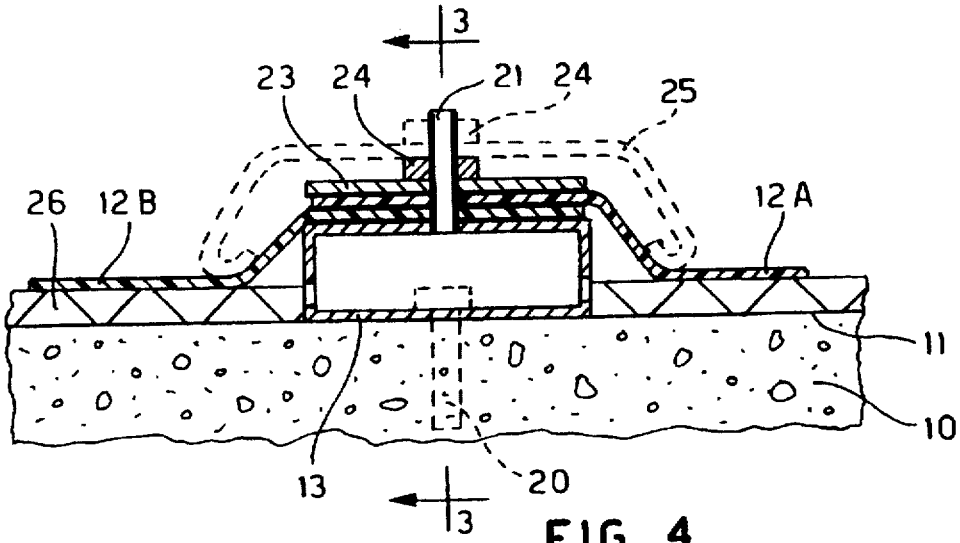
FIG. 4 is a cross sectional view along line 4—4 of FIG. 3.

As can be seen in cross-sectional views of FIGS. 3 and 4, metal profiles 13 can be in the shape of box-type or tubular elements, or Ω shaped elements, suitably positioned against the surface 11 to constitute a system of vertical conduits for discharge of the condensation water seeping inside the water collection chamber according to the principle described in the previous U.S. Pat. No. 5,143,480. In the case of the example of the present invention, to install underwater the impermeable membrane 12, each profile 13 is constructed with aligned holes 19, 19' to allow insertion of the anchorage elements 20, being holes 19 on one side and corresponding holes 19' on the other side at predetermined locations, and a certain number of threaded studs 21 are provided in suitable positions, at the front side of the metal profiles 13 to allow subsequent watertight anchorage of the sheet material constituting the membrane 12, as will be explained hereafter. The studs 21 are directly welded or otherwise fixed to the profile 13, as schematically shown.

In a similar way, the profile 15 is provided with identical threaded studs 21' for the watertight anchorage of the bottom edge of the membrane 12.

More in detail, as illustrated in the enlarged cross sectional view of FIGS. 3 and 5, at the vertical profile 13 the opposed edges 12*a* and 12*b* of two adjoining sheets partially overlap, envisaging possible interposition of suitable sealing gaskets between the sheets and the profile; the watertight anchorage between the overlapping edges 12*a* and 12*b* of the two sheets can be made by flat profiles 23, blocked in position by nuts 24 screwed on threaded studs 21. In addition, as schematically shown in FIG. 4, a channel shaped profile 25 can be installed, with wings facing towards the surface 11, to push and make the edges 12*a* and 12*b* of the sheets adhere against a drainage layer 26 determining an air chamber or space for collection of the condensed water coming from the hydraulic structure body 10, or of water which may infiltrate through fissures which, over time, can form in the protective sheathing or membrane 12. In substitution or in addition to the mechanical connections between the opposed edges of the adjoining material sheets of the membrane 12, a watertight connection accomplished by welding, always made underwater, could also be used. In a similar way to what is illustrated in FIGS. 4 and 5, the bottom edge of the membrane 12 is watertightly fixed to the profile 15 of a second profile 27, flat or shaped, with suitable watertightness gaskets in between.

Figure 6:
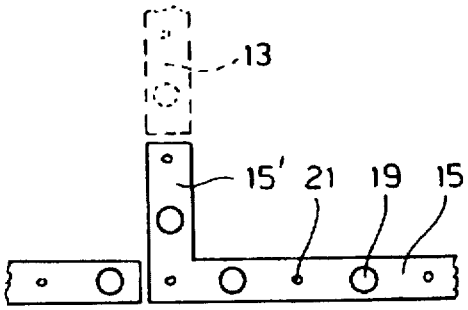
FIG. 6 is a front view of the profiles in a connection point between the vertical profile and the bottom profile, according to a first construction type.
Figure 7:
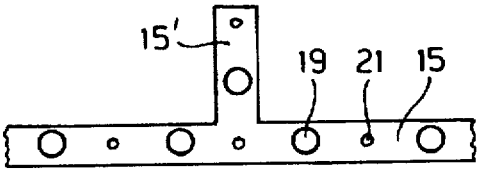
FIG. 7 is a view similar to that in FIG. 6, according to a second construction type.

To accomplish a chamfered connection between each vertical profile 13 and the base profile 15, in order to adequately position the membrane 12 in the transition zone, the base profile 15, or the various sections which constitute it, can have, in correspondence of each vertical profile 13, a short element 15', in the shape of a wedge, which from the bottom part of profile 13 is tapered towards the upper edge of the base profile 15, in the illustrated way. The wedge shaped connection elements 15' can be installed at one or both ends of the profile 15, as illustrated in FIG. 6, or in an intermediate position as illustrated in FIG. 7. Obviously, the connection elements 15' will have suitable holes for the crossing of the anchorage means and respectively of suitable threaded studs 21' for the impermeable membrane.

Installation of the impermeable membrane, operating underwater, to construct the waterproofing sheathing of the whole hydraulic structure, can be accomplished according to the following procedure. After having performed the necessary surveys and preparation of the surface of the hydraulic structure to be protected, accurately defining the limits or the outline of the area where the membrane will be installed, at least one reference line of the entire installation is set up, by positioning an alignment cable which runs vertically near and parallel to one side of the area which must be covered by the membrane. Then the various profiles 13, 15 are anchored, as previously illustrated, by suitable equipment. Then the various material sheets to construct the membrane 12 are deployed, positioned underwater over the surface to be protected, keeping one lateral edge of each sheet aligned with the reference cable. During positioning and/or deployment underwater of each material sheet, care must be taken to always maintain a balanced condition of the water pressures acting on the two faces of each sheet and of the membrane which is under construction. Practically installation proceeds as follows: each material sheet, of the desired size, with holes already punched on the edges for crossing of the threaded studs for anchorage, is prepared. Keeping the sluice valve 14' of the discharge conduits 14, previously constructed, completely closed, the single sheets 12 are for example gradually deployed and lowered along the surface 11 of the hydraulic structure, parallel to the reference line, overlapping the opposed edges of the sheets and positioning the suitable watertightness gaskets in between; the edges of the single sheets are then watertight blocked by flat profiles 23 and/or profiles 27, proceeding gradually to line the entire surface 11. Instead of deploying and lowering each sheet from the top, according to an alternative procedure deployment of the material sheet roll can be made upwardly from the bottom to the top. As the sluice valves of the discharge conduits 14 are closed. In this way operations are made in conditions of perfect compensation or balance of the water pressures acting on the two faces of each sheet, that is on the entire front and rear surfaces of the membrane under construction, avoiding that this be abruptly sucked against the surface 11 of the structure, hampering any further possibility of positioning it, thus avoiding the membrane itself from being subject to high stresses which could cause its tearing or failure in the most highly stressed points. After the watertight sealing along the perimeter edge and along the vertical profiles of the entire membrane has been perfectly constructed, the pressure on the back side of the membrane can be gradually reduced by draining the water which is left between the membrane 12 and the body 10 of the hydraulic structure, for example opening the sluice valves 14' to completely discharge the remaining water. Drainage and discharge of water could be accomplished also with other systems, for example by means of pumps from the top or, in alternative, from the side of the membrane in contact with water, envisaging a suitable hole or series of holes along the bottom edge of the membrane, connected with discharge pipes facing towards the side of the reservoir. In such a case, the water drainage capacity must be increased envisaging for example the interposition of one or more superimposed layers of a geonet, or by installation of a series of horizontal profiles suitable for supporting the impermeable membrane at a greater distance from the surface to be protected to be able to convey the drained water to the discharge point.

In this way, between the two opposed surfaces an air chamber is formed in correspondence to the drainage layer 26, which is practically at atmospheric pressure, for discharge of the condensed and infiltration water. When the protection membrane covers only one part of the surface of the hydraulic structure, with a watertight sealing along the whole perimeter of the protected area, the atmospheric pressure in the drainage chamber formed between the membrane and the surface of the protected hydraulic structure can be achieved by any ventilation system suitable for the aim at issue. As the discharge of water, trapped between the waterproofing membrane 12 and the surface 11 of the hydraulic structure, is made by discharge conduits 14 which are positioned at the bottom, a gradual reduction of the pressure is thus achieved, from the top to the bottom, without causing any sudden pressure variations or stresses on the membrane, which thus lies against the net-like structure 26 which forms the air chamber or the drainage layer.

It is however obvious that in any case the possibility of constructing underwater a protection sheathing is achieved, without the need to completely discharge the water in order to allow execution of repairs, operating in an extremely reliable way, without subjecting the membrane to excessive stresses.

Figure 8:
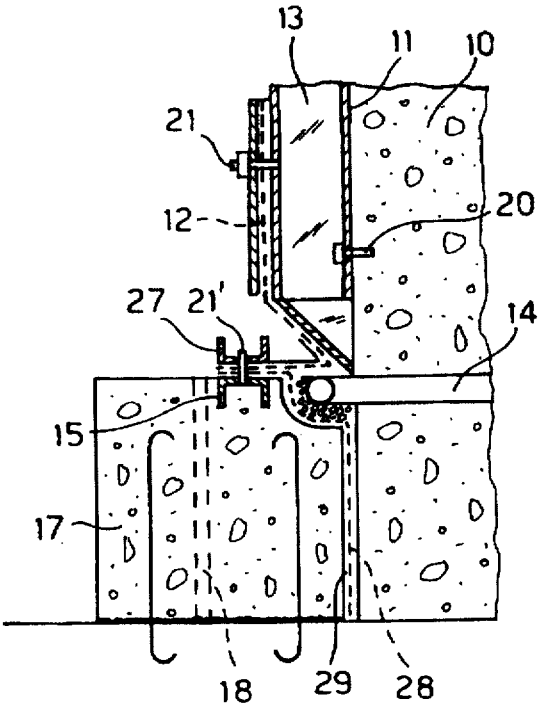
FIGS. 8 and 9 illustrate further construction types of the invention.

FIG. 8 illustrates the solution in case a reinforcement element should be constructed at the heel of the dam, thus constituting a beam for the bottom anchorage. In this case it is better, before casting of beam 17, to install all along the perimeter an impermeable sheathing 28, taking care of turning the upper edge of the sheathing over beam 17. Even in this case, beam 17 can be equipped with holes 18 for grouting with waterproofing resins, in addition to a profile 15 for anchoring the edges of the sheathing, in the aforementioned way.

In the various figures and in the above description, some possible configurations of the profiles and of the mechanical anchorage system of the various impermeable sheets constituting the protection membrane 12 are illustrated. The profiles however may as well be different or even be lacking, in such a case the membrane 12 being anchored to the surface to be protected by other mechanical anchorage means, such as nails or bolts directly fastened in the concrete body of the hydraulic structure to be protected, provided they constitute an adequate watertight connection.

The net-like structure 26 has draining and antipuncturing functions, and can consist of geonets, geotextiles or similar materials.

The structure 26 can be coupled during production to the impermeable sheathing 12, thus constituting a geocomposite.

Figure 9:
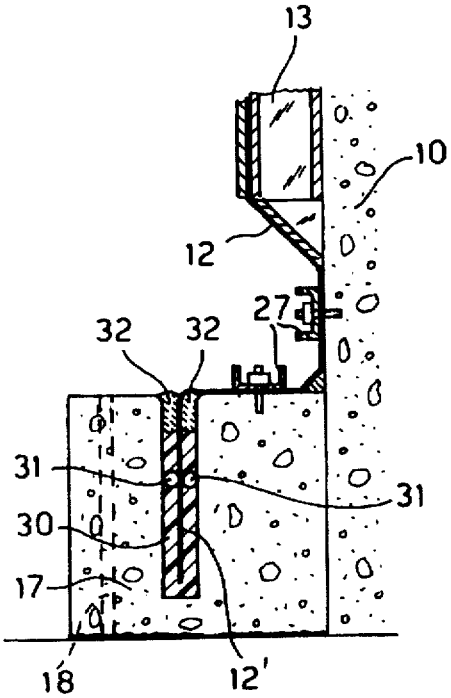

Finally, FIG. 9 of the enclosed drawings illustrates a different watertight anchorage system of the covering sheets by means of attachment with resins to the anchorage beam which is located along the bottom perimeter of the hydraulic structure. More precisely, as illustrated in the above figure, the lower edge 12' of the sheets which constitute the impermeable membrane 12 is inserted in a groove 30 which is located longitudinally inside the beam 17 and which includes pipes 31 for grouting the epoxy resin or other resins suitable for underwater polymerisation, so as to soundly and watertightly anchor the edge 12' of the sheets. In the non-horizontal sections of beam 17, when introducing the edge 12' of the sheets in groove 30, before injection of the resin, it is possible to envisage a stopping with a hard setting epoxy, on both sides of the sheets and along the corresponding sections of groove 30, to act as a formwork which avoids overflow of the resin anchoring the impermeable membrane.

What is claimed is:

1. A method for constructing an impermeable protective membrane underwater on at least part of a hydraulic structure, by which the membrane, comprising flexible sheets of impermeable material, is anchored to the hydraulic structure to be protected, the method comprising the following steps:

defining a surface to be protected;

providing said surface with at least one reference line;

constructing the membrane underwater by sequentially positioning each sheet of material side-by-side over the surface, such that facing edges of adjacent sheets overlap, keeping one lateral edge of said each sheet of material parallel to said reference line;

watertightly sealing the overlapped edges of the sheets, while maintaining hydrostatically balanced conditions between pressures acting on front and rear faces of said each sheet of material; and anchoring each sheet of material to the hydraulic structure by mechanical anchorage devices on the surface to construct the impermeable protective membrane underwater on at least part of the hydraulic structure.

2. The method according to claim 1, further comprising a step of tensioning each sheet of material using tensioning means cooperating with the mechanical anchorage devices.

3. The method according to claim 1, further comprising a step of providing a water collecting chamber, between the rear face of the membrane and the surface of the hydraulic structure, for reducing the pressure behind the membrane by gradually draining water collected in the collecting chamber between the rear face of the membrane and the surface.

4. The method according to claim 3, further comprising a step of reducing the pressure on the rear face of the impermeable membrane, facing the surface to be protected, by gradually reducing a level of the water from a top to a bottom of said chamber.

5. The method according to claim 1, wherein said anchoring step includes anchoring a lower edge of the membrane to one of the hydraulic structure and a reinforcement beam, wherein said reinforcement beam is at least one of internal and external to the hydraulic structure.

6. The method according to claim 5, wherein said anchoring step includes waterproofing an interface between the reinforcement beam and at least one of a corresponding surface of the hydraulic structure and underlying soil.

7. The method according to claim 6, wherein the waterproofing is provided by grouting with resins through grouting pipes installed in the reinforcement beam.

8. The method according to claim 6, wherein the waterproofing of the interface is provided by an impermeable sheathing, along the interface.

9. The method according to claim 5, wherein the beam is connected to a base anchorage profile of the mechanical anchorage devices at the lower edge of the membrane, vertical anchorage profiles of the mechanical anchorage devices connect the membrane to the hydraulic structure, and wedge-shaped connection elements at a bottom of the vertical anchorage profiles slant towards the surface.

10. The method according to claim 5, wherein the flexible sheets are connected to the reinforcement beam along a bottom perimeter of the hydraulic structure by embedment with resins.

11. The method according to claim 1, further comprising steps of:

draining water present inside a body of the hydraulic structure, by tube-like profile members defining a discharging conduit system at atmospheric pressure for discharge of water collected in a space between the surface and the sheets, said mechanical anchorage devices including anchoring profiles at a lower edge of the membrane, along a bottom perimeter of the hydraulic structure to be protected, said anchoring profiles being embedded, where necessary, in a reinforcement beam;

watertightly connecting the sheets of material by anchoring them to the profiles, maintaining said hydrostatically balanced conditions; and subsequently adhering the membrane to a drainage layer on the surface, gradually reducing pressure of the water between the membrane and the surface of the hydraulic structure.

12. The method according to claim 1, wherein the sealing step is carried out by at least one of the mechanical anchorage devices and welding underwater.

13. A method for constructing an impermeable protective membrane underwater on at least part of a hydraulic structure, by which the membrane, comprising flexible sheets of impermeable material, is anchored to the hydraulic structure to be protected, the method comprising the following steps:

defining a surface to be protected;

providing said surface with at least one reference line;

constructing the membrane underwater by sequentially positioning each sheet of material side-by-side over the surface, such that facing edges of adjacent sheets overlap, keeping one lateral edge of said each sheet of material parallel to said reference line;

watertightly sealing the overlapped edges of the sheets, while maintaining hydrostatically balanced conditions between pressures acting on front and rear faces of said each sheet of material;

anchoring each sheet of material to the hydraulic structure by mechanical anchorage devices on the surface to construct the impermeable protective membrane underwater on at least part of the hydraulic structure; and reducing the pressure on the rear face of the membrane by gradually discharging the water by at least one of gravity and pumping.

* * * * *